US007770659B2

(12) United States Patent
Uelhoff et al.

(10) Patent No.: US 7,770,659 B2
(45) Date of Patent: Aug. 10, 2010

(54) ROTARY DRIVE ASSEMBLY FOR A DRILL ROD

(75) Inventors: Henrik Uelhoff, Drolshagen (DE); Andreas Pikowski, Drolshagen (DE)

(73) Assignee: Eurodrill GmbH, Drolshagen (DE)

( * ) Notice: Subject to any disclaimer, the term of this patent is extended or adjusted under 35 U.S.C. 154(b) by 0 days.

(21) Appl. No.: 12/000,655

(22) Filed: Dec. 14, 2007

(65) Prior Publication Data

US 2008/0164044 A1 Jul. 10, 2008

(30) Foreign Application Priority Data

Dec. 18, 2006 (EP) ..... 06026207

(51) Int. Cl.
*E21B 4/04* (2006.01)

(52) U.S. Cl. ..... 173/1; 173/78; 173/184

(58) Field of Classification Search ..... 173/1, 173/78, 89, 105, 184, 147, 97; 175/323, 175/170, 171, 173; 405/232
See application file for complete search history.

(56) References Cited

U.S. PATENT DOCUMENTS 3,322,466 A * 5/1967 Mennekes ..... 299/60
3,565,190 A * 2/1971 Morindo Ishii ..... 175/171
5,358,060 A * 10/1994 Ebara ..... 175/108
6,079,906 A * 6/2000 Herrero Codina ..... 405/251
7,093,679 B1 * 8/2006 Watson ..... 175/170
7,389,831 B2 * 6/2008 Mullins et al. ..... 175/62

FOREIGN PATENT DOCUMENTS

| | | |
|---|---|---|
| DE | 4402487 | 7/1995 |
| DE | 19704263 | 8/1998 |
| DE | 19732479 | 4/1999 |
| DE | 19906687 | 8/2000 |
| DE | 10005475 | 8/2001 |
| EP | 1124037 | 8/2001 |

* cited by examiner

*Primary Examiner*—Rinaldi I. Rada
*Assistant Examiner*—Nathaniel Chukwurah
(74) *Attorney, Agent, or Firm*—Jacobson Holman PLLC

(57) ABSTRACT

The invention relates to a rotary drive assembly for a drill rod having an outer tube and an inner rod extending at least in sections inside the outer tube, comprising a first gear unit having at least a first drive unit for driving the inner rod in a rotating manner and a second gear unit, which is offset to the said first gear unit in the longitudinal direction of the drill rod and has at least a second drive unit for driving the outer tube in a rotating manner. In accordance with the invention provision is made for the second drive unit to be spaced from the second gear unit and for the second drive unit to be arranged adjacent to the first drive unit on the first gear unit.

20 Claims, 1 Drawing Sheet

ROTARY DRIVE ASSEMBLY FOR A DRILL ROD

BACKGROUND OF THE INVENTION

1. Field of the Invention

The invention relates to a rotary drive assembly for a drill rod having an outer tube and an inner rod extending at least in sections inside the outer tube, in particular for double-head and/or superposed drilling.

2. Related Art

A rotary drive assembly of such type includes a first gear unit having at least a first drive unit for driving the inner rod in a rotating manner and at least a second gear unit, which is arranged offset to the said first gear unit in the longitudinal direction of the drill rod and has at least a second drive unit for driving the outer tube in a rotating manner.

Rotary drive assemblies for double-head drilling devices are known that have two gear units arranged one behind the other in the longitudinal direction of the drill rod, in which case one of the gear units serves for the rotating operation of the inner rod while the other serves for the rotating operation of the outer tube of the drill rod. To drive the two gear units a hydraulic drive unit is each mounted on the two associated gear housings, with the drive shaft of each gear unit being directly connected to the associated drive unit.

However, such drive assemblies can have a comparatively large constructional length in the direction of the drill rod, that results from the sum of the constructional lengths of both gear units as well as both drive units. With a view to achieving a length of utilization as large as possible, i.e. an insertion depth of the drill rod, a constructional length as short as possible is generally to be aimed for.

Further rotary drive assemblies are known from DE 197 04 263 C1 and DE 100 05 475 A1. These drive assemblies have a common drive unit, the torque of which is distributed upon a different rotational direction both to the outer tube and to the inner rod. In these known assemblies there usually exists a forced synchronization of the rotational speed of the outer tube with the rotational speed of the inner rod.

SUMMARY OF THE INVENTION

The object of the invention is to provide a rotary drive assembly which can be employed in a great variety of applications whilst ensuring a high reliability and which has, in particular, an especially short constructional length.

In accordance with the invention the object is solved by a rotary drive assembly having a first gear unit having at least a first drive unit for driving the inner rod in a rotating manner and a second gear unit, which is offset to the first gear unit in the longitudinal direction of the drill rod and has at least a second drive unit for driving the outer tube in a rotating manner, wherein the second drive unit is spaced from the second gear unit and the second drive unit is arranged adjacent to the first drive unit on the first gear unit.

The rotary drive assembly according to the invention is characterized in that the second drive unit is spaced from the second gear unit and that the second drive unit is arranged adjacent to the first drive unit on the first gear unit.

A fundamental idea of the invention can be seen in the fact that the drive unit for the outer tube is not provided directly on the gear unit for the outer tube but that this drive unit is rather arranged in the area of the rear gear unit for the inner rod, which is offset backwards with respect to the gear unit for the outer tube in a direction contrary to the drilling direction. As a result, the space required for drive means in the area of the second gear unit close proximity to the borehole, is reduced which may be of advantage with regard to operational safety and reliability. In particular, the drive unit for the outer tube can be arranged by being spaced from the intermediate space between the two gear units so that these gear units can be positioned especially close to each other and a particularly small constructional length and therefore a particularly great insertion depth can be achieved. Moreover, the invention allows for a particularly simple and compact installation of the operating lines of the drive units, especially of hydraulic lines, and of control valves that may perhaps be provided, since these lines and valves can be joined in the area of the first, rear gear unit.

Due to the fact that, according to the invention, independent drive units are employed for the outer tube and the inner rod, it is possible for the outer tube and the inner rod to be operated independently of each other in an especially versatile way. More particularly, the rotational speed and/or the torque of the outer tube can be varied relative to the inner rod and provision can be made in a particularly simple manner for an operation both in the same and in opposite direction.

It is particularly advantageous for the first drive unit and/or the second drive unit to be arranged on a housing of the first gear unit, which permits an especially easy mounting of the two drive units. In order to ensure easy access to the drive units it is of advantage that these are arranged, at least to some degree, on the outside of the housing.

Furthermore, according to the invention it is especially advantageous that the first drive unit and/or the second drive unit are arranged on a rear side of the first gear unit that faces away from the second gear unit. Having such a rearward arrangement on the first gear unit, which lies at the rear as seen in the drilling direction, i.e. which faces away from the borehole, there is especially good access to the drive units and, in particular, without requiring a demounting of any gear units, which may be of advantage with regard to the maintenance of the drive units for example. What is more, this arrangement allows for an especially compact constructional design, and in particular for an especially short constructional length.

For a particularly simple and reliable transmission of force from the second drive unit to the second gear unit for the outer tube it is of advantage that for the operation of the second gear unit at least one drive shaft is provided, which extends from the second drive unit to the second gear unit. In particular, to achieve an especially compact constructional design it is suitable for the drive shaft to extend, at least in sections, parallel to the drill rod. By preference, a drive pinion of the second gear unit, which can be designed as a spur gear for example, is arranged on the drive shaft. If several second drive units are provided for the outer tube, it is suitable that a shaft is arranged on each of these drive units, which has a drive pinion for the second gear unit arranged in front as seen in the drilling direction. For best suitability, all of these shafts extend parallel to one another. The drive shaft can be designed e.g. as a rigid shaft or as a Cardan shaft.

The design of the drive shaft as a Cardan shaft can be especially advantageous if the two gear units, which are preferably designed as spur gears, have a different transmission. In particular in this case the drive pinions of the two gear units can have a different distance to the drilling axis. Here the use of a Cardan shaft makes it possible to compensate the different center distances of the drive pinions to the drilling axis and to arrange the first drive unit for the inner rod and the second drive unit for the outer tube with the same center distance to the drilling axis.

For a particularly compact constructional design it is of advantage that the housing of the first gear unit has a recess through which the drive shaft for the second gear unit extends.

An especially economical rotary drive assembly is provided in that the first drive unit and the second drive unit are at least approximately of identical constructional design. In this case only a single type of drive unit needs to be kept in store for the production and repair of the rotary drive assembly.

Furthermore, it is particularly advantageous that the number of the second drive units is higher than the number of the first drive units. More particularly, two second drive units and one first drive unit can be provided. As a result, it is possible to supply a higher rotational speed, in particular a higher torque, to the outer tube as compared to the inner rod, whereby an especially good drilling progress can be attained.

If three drive units are provided, the first drive unit is suitably located between the two second drive units. In such case the centrally arranged drive unit drives the gear unit of the inner rod, whereas the two outer drive units are assigned to the gear unit of the outer tube.

A rotary drive assembly having an especially simple and at the same time reliable construction is provided in that the first gear unit and/or the second gear unit has a spur gear. The spur gear can have a single-stage or a multi-stage design.

For best suitability a coupling for the inner rod is provided on the output shaft of the first gear unit and a coupling for the outer tube is provided on the output shaft of the second gear unit.

In addition, it is of advantage that, especially with regard to the work involved in manufacturing and maintenance, the two gear units have at least approximately the same transmission. If the same transmission of both gear units is provided, the number of the second drive units for the outer tube is suitably higher than the number of the first drive units for the inner rod and/or the at least one second drive unit is dimensioned with a higher performance than the at least one first drive unit, because, more often, a higher torque is required for the outer tube than for the inner rod.

For best suitability the drive units each have a drive motor designed as a hydraulic motor. In particular, the drive motor of at least one of the drive units can have a reduction gear that is designed as a planetary gear for example.

In accordance with a further preferred embodiment of the invention it is advantageous for the drive units to be arranged on an arc, preferably on a circular arc that extends around the drill rod and/or the drilling axis. With regard to the absorption of force this may prove to be especially advantageous, namely in particular in the case in which more than two drive units are provided. It is of particular advantage if the drive units have at least approximately the same external dimensions. Through this an arc-like arrangement of the drive units is rendered possible in an especially simple way.

Moreover, according to the invention it is of advantage that a support plate is provided on which the drive units are arranged. This support plate suitably extends perpendicularly to the drilling axis, i.e. the longitudinal axis of the drill rod. In particular, the support plate can constitute a part, e.g. a back plate, of the gear housing of the first gear unit.

For particularly compact external dimensions it is advantageous that the housing of the first gear unit and/or a housing of the second gear unit are formed in a box-type manner.

Furthermore, according to the invention it can be preferred that the housing of the first gear unit is spaced from the housing of the second gear unit in the longitudinal direction of the drill rod. Through such a construction in particular a free space can preferably be formed between the two gear units, which permits access from the outside to the inner rod and/or allows an adapter device for the inner rod. Such a free space can make a particularly easy mounting or demounting of the inner rod on the first gear unit possible.

For an especially distortion-resistant arrangement it is advantageous that at least one strut is provided that connects the housing of the first gear unit with the housing of the second gear unit.

Another preferred embodiment of the invention resides in the fact that the two gear units can be displaced relative to each other in the longitudinal direction of the drill rod. For instance provision can be made for the gear units to be displaced in opposition to each other in order to mount and/or demount the drill rod. Provision can also be made for the two gear units to be displaced in opposition to each other during drilling, which can lead to a corresponding relative movement of the inner rod, that is arranged in an axially fixed manner on the first drive unit, with respect to the outer tube, that is arranged in an axially fixed manner on the second drive unit. As a result, an especially versatile rotary drive assembly is obtained.

If the two gear units can be displaced relative to each other, it is of advantage that the drive shaft has a torque-fixed sliding seat for changing its length during a relative displacement of the gear units. Such a sliding seat permits a change of length of the drive shaft and therefore a compensation of the change in the distance that occurs during displacement between the second drive unit, which is arranged in a fixed manner on the first gear unit, and the second gear unit. For the torque transmission the sliding seat can have a splined-shaft profile for example.

For the active relative displacement of the two gear units with respect to each other e.g. at least one linear drive, in particular a hydraulic cylinder, can be provided. Advantageously, this drive is arranged at least in sections in an area between the two gear units. In another preferred embodiment the linear drive extends at least in sections on a rear side of the first gear unit that faces away from the second gear unit.

To achieve an especially good drilling progress in certain soil geologies in particular it is of advantage that a percussion unit for the drill rod is provided, by means of which the inner rod, in particular, can be operated in a striking manner. By preference, the percussion unit is provided on the rear side of the first gear unit that faces away from the second gear unit.

The rotary drive assembly according to the invention is especially suitable for double-head drilling and/or superposed drilling. More particularly, the rotary drive assembly can be provided for a counter-rotating operation of the outer tube with respect to the inner rod. For best suitability the outer tube is designed as a drill tube having a drill bit arranged at its end. The inner rod appropriately has an auger and, in particular, a soil-stripping portion arranged at the end.

The invention also comprises a method for producing a borehole, in particular in the soil, in which a drill rod having an outer tube and an inner rod extending at least in sections inside the outer tube is set in rotation and displaced axially by means of a rotary drive assembly according to the invention. As a result, the advantages set out in conjunction with the device according to the invention can be implemented in a method.

BRIEF DESCRIPTION OF THE DRAWINGS

In the following the invention will be described in greater detail by way of preferred embodiments that are shown schematically in the Figures, wherein.

Elements having the same function are designated throughout the Figures with the same reference signs.

DETAILED DESCRIPTION OF THE PREFERRED EMBODIMENTS

Figure 1:
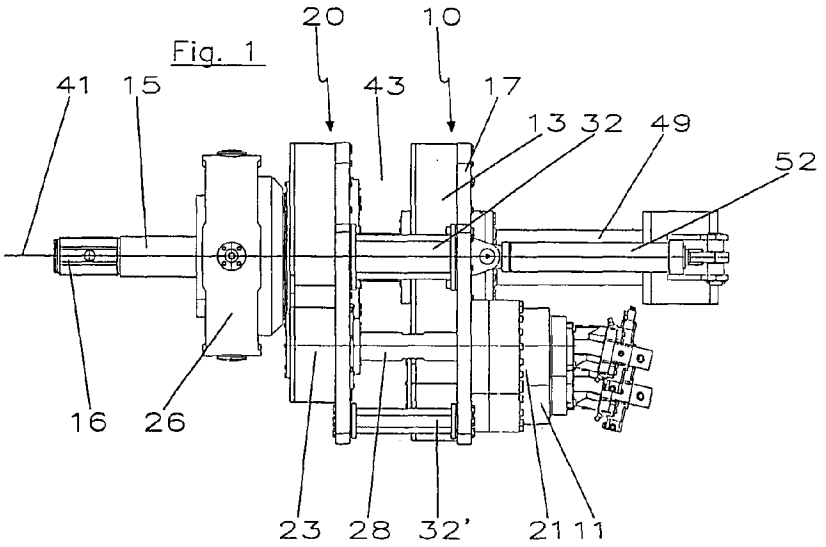
FIG. 1 shows a lateral view of an embodiment of a rotary drive assembly according to the invention.
Figure 4:
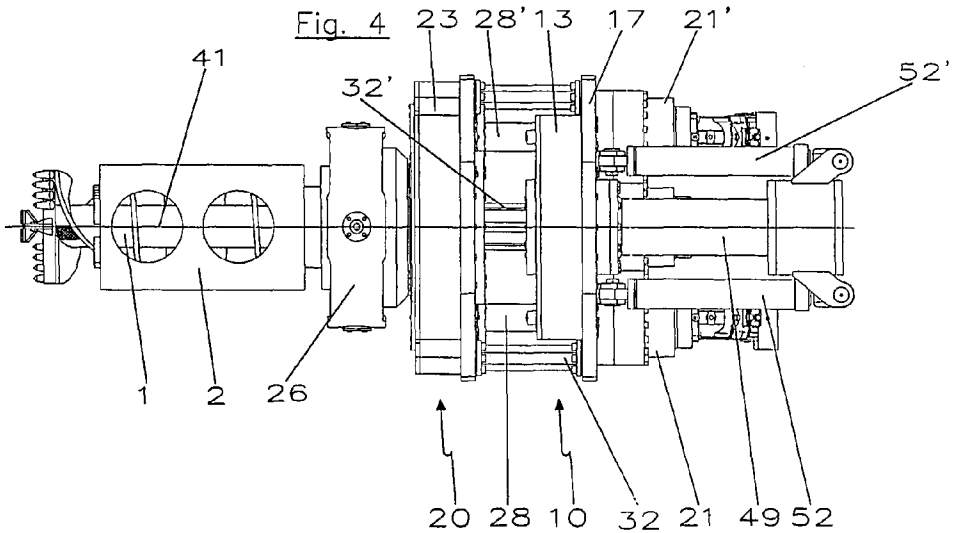
FIG. 4 shows a top view of the rotary drive assembly of FIG. 1 with mounted drill rod and drill tube.
Figure 2:
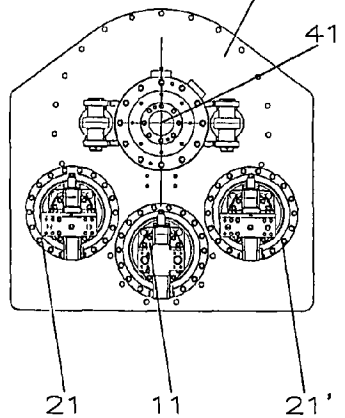
FIG. 2 shows a rear view of the rotary drive assembly of FIG. 1.
Figure 3:
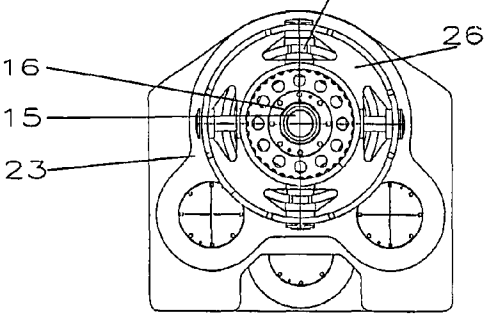
FIG. 3 shows a front view of the rotary drive assembly of FIG. 1.

An embodiment of a rotary drive assembly according to the invention is shown in FIGS. 1 to 4. The rotary drive assembly has a first gear unit 10 to operate an inner rod 1 depicted in FIG. 4 in a rotating manner and a second gear unit 20 to operate an outer tube 2 depicted in FIG. 4 in a rotating manner, in which case the outer tube 2 encompasses the inner rod 1 coaxially. Both gear units 10, 20 are designed as spur gears.

The two gear units 10, 20 are arranged in an offset manner in the direction of the drilling axis 41 that extends longitudinally and centrally through the inner rod 1 and the outer tube 2. The first gear unit 10 has a box-shaped housing 13 and the second gear unit 20 has a box-shaped housing 23. The two housings 13, 23 are kept at a distance by means of struts 32, 32' that extend parallel to the drilling axis 41 and are arranged at their ends at a respective one of the housings 13, 23.

At the front side of the second gear unit 20, which faces towards the drill rod and is arranged in front as seen in the drilling direction, a first adapter coupling 16 for the inner rod 1 and a second adapter coupling 26 for the outer tube 2 are provided. The first adapter coupling 16 for the inner rod 1 which is designed as a polygonal profile is arranged at its end on a shaft 15 that runs through the second adapter coupling 26 as well as the second gear unit 20 with its housing 23 and is guided to the first gear unit 10, by which it can be operated in a rotating manner. Between the two axially offset housings 13, 23 of the two gear units 10, 20 a free space 43 is formed that permits access to the shaft 15 between the two gear units 10, 20. The second adapter coupling 26 for the outer tube 2 encompasses the shaft 15 coaxially and has clamping jaws 27 in order to secure the outer tube 2 in a rotatably fixed manner.

To operate the first gear unit 10 for the inner rod 1 in a rotating manner a drive unit 11 is provided. To operate the second gear unit 20 for the outer tube 2 in a rotating manner two drive units 21, 21' are provided. All three drive units 11, 21, 21' are substantially constructed in the same, way, essentially having the same performance and being designed as hydraulic rotary drives.

All three drive units 11, 21, 21' are arranged on the rear side of the first gear unit 10 on its housing 13 that faces away from the second gear unit 20 for the outer tube 2. On its rear side the housing 13 of the first gear unit 10 has a support plate 17 that extends perpendicularly to the drilling axis 41 and to which the drive units 11, 21, 21' are flanged. As can be taken from FIG. 2 in particular, the drive units 11, 21 and 21' of substantially identical construction are arranged on a circle extending around the drilling axis 41. Here the drive unit 11 for the inner rod 1 is provided centrally between the two drive units 21 and 21' for the outer tube 2.

For the torque transmission between the drive units 21, 21' and the second gear unit 20 for the outer tube 2 a respective drive shaft 28, 28' is provided on the drive units 21, 21'. The drive shafts 28, 28' run parallel to the drilling axis 41 and extend from the drive units 21, 21' through respective recesses in the housing 13 and through the free space 43 to the second gear unit 20 at the front. Here, drive pinions are arranged on the drive shafts 28, 28', which cannot be seen in the Figures and through which the second gear unit 20 can be operated. The first drive unit 11 equally has a drive shaft that cannot be seen in the Figures. Likewise, a pinion is arranged on this drive shaft that serves to operate the first gear unit 10.

On the rear side of the first gear unit 10 that faces away from the second gear unit 20 a housing extension with at least one bearing location for the shaft 15 or alternatively for a percussion unit 49 is provided, through which the shaft 15 and therefore the inner rod 1 can be operated in a striking manner in the direction of the drilling axis 41. In addition, on the rear side of the first gear unit 10 two hydraulic cylinders 52, 52' are provided that extend from the housing 13 towards the rear and parallel to the drilling axis 41. These cylinders 52, 52' can serve for the axial displacement of the inner rod 1 relative to the outer tube 2. In particular, with these cylinders e.g. a fixed bearing for the shaft 15 and/or the inner rod 1 can be displaced axially.

In another embodiment the hydraulic cylinders 52, 52' can serve for the axial displacement of the two gear units 10, 20 relative to each other.

The invention claimed is:

1. Rotary drive assembly for a drill rod having a drill axis, an outer tube rotatable about the drill axis, and an inner rod extending at least in sections inside the outer tube and rotatable about the drill axis, comprising a first gear unit for driving the inner rod in a rotating manner, the first gear unit including a first gear rotatable about the drill axis, one first drive unit having a first motor for operating the first gear unit for driving the inner rod in a rotating manner, a second gear unit for driving the outer tube in a rotating manner, the second gear unit being offset to the first gear unit in the longitudinal direction of the drill rod and including a second gear rotatable about the drill axis, and two second drive units each having a second motor for operating the second gear unit for driving the outer tube in a rotating manner about the drill axis, wherein the first drive unit is arranged in between the two second drive units, wherein the second drive units are spaced from the second gear unit and the second drive units are arranged adjacent to the first drive unit, with the first drive unit and the second drive units all being arranged on the first gear unit on a side thereof facing away from the second gear unit.

2. Rotary drive assembly according to claim 1, wherein the first gear unit includes a housing, the first gear being housed in the housing, and the first drive unit and the second drive units are arranged on the housing of the first gear unit.

3. Rotary drive assembly according to claim 1, wherein for the operation of the second gear unit one drive shaft is provided for each of the two second drive units.

4. Rotary drive assembly according to claim 3, wherein the first gear unit includes a housing, the first gear being housed in the housing, and the housing of the first gear unit has two recesses, through which the drive shafts for the second gear unit respectively extend.

5. Rotary drive assembly according to claim 3, wherein the first and second gear units are displaceable relative to each other in the longitudinal direction of the drill rod, and each drive shaft has a torque-fixed sliding seat for changing its length during a relative displacement of the gear units.

6. Rotary drive assembly according to claim 3, wherein each drive shaft is a Cardan drive shaft.

7. Rotary drive assembly according to claim 3, wherein the each drive shaft extends at least in sections parallel to the drill rod from the second drive units to the second gear unit.

8. Rotary drive assembly according to claim 1, wherein at least one of the first gear and the second gear is a spur gear, and the first and second gear units have at least approximately the same transmission.

9. Rotary drive assembly according to claim 1, wherein the first drive unit and the two second drive units are arranged on an arc that extends around the drill rod and a support plate is provided on which the first drive unit and the two second drive units are arranged.

10. Rotary drive assembly according to claim 1, wherein the first gear unit includes a housing, the first gear being housed therein, the second gear unit includes a housing, the second gear being housed therein, at least one of the housing of the first gear unit and the housing of the second gear unit is formed in a box-type manner, the housing of the first gear unit is spaced from the housing of the second gear unit in the longitudinal direction of the drill rod and at least one strut is provided which connects the housing of the first gear unit with the housing of the second gear unit.

11. Method for producing a borehole using the rotary drive assembly according to claim 1, comprising:

setting the drill rod into rotation and axially displacing the drill rod using the rotary drive assembly.

12. Rotary drive assembly according to claim 1, wherein the rotary drive assembly includes a drill rod having an outer tube and an inner rod extending at least in sections inside the outer tube, for one of double-head drilling and superposed drilling.

13. Rotary drive assembly according to claim 1, wherein the drive units are arranged on an arc that extends around the drill rod.

14. Rotary drive assembly according to claim 1, wherein a support plate is provided on which the drive units are arranged.

15. Rotary drive assembly according to claim 1, wherein the first gear unit includes a housing, the first gear being housed therein, the second gear unit includes a housing, the second gear being housed therein, at least one of the housing of the first gear unit and the housing of the second gear unit is formed in a box-type manner, and the housing of the first gear unit is spaced from the housing of the second gear unit in the longitudinal direction of the drill rod.

16. Rotary drive assembly according to claim 1, wherein the first gear unit includes a housing, the first gear being housed therein, the second gear unit includes a housing, the second gear being housed therein, at least one of the housing of the first gear unit and the housing of the second gear unit is formed in a box-type manner, and at least one strut is provided which connects the housing of the first gear unit with the housing of the second gear unit.

17. Rotary drive assembly according to claim 1, wherein the first drive unit and the second drive units are at least approximately of identical constructional design.

18. Rotary drive assembly according to claim 1, further comprising a drive shaft provided on each of the two second drive units, for transmitting torque between the two second drive units and the second gear unit, where each drive shaft runs parallel to the drilling axis.

19. Rotary drive assembly for a drill rod having a drill axis, an outer tube rotatable about the drill axis, and an inner rod extending at least in sections inside the outer tube and rotatable about the drill axis, comprising a first gear unit for driving the inner rod in a rotating manner, the first gear unit including a housing and a first gear housed therein, the first gear being rotatable about the drill axis, one first drive unit having a first motor for operating the first gear unit for driving the inner rod in a rotating manner, a second gear unit for driving the outer tube in a rotating manner, the second gear unit being offset to the first gear unit in the longitudinal direction of the drill rod and including a housing and a second gear housed therein, the second gear being rotatable about the drill axis, and two second drive units each having a second motor for operating the second gear unit for driving the outer tube in a rotating manner about the drill axis, wherein the first drive unit is arranged in between the two second drive units, wherein the second drive units are spaced from the second gear unit and the second drive units are arranged adjacent to the first drive unit, with the first drive unit and the second drive units all being arranged on the housing of the first gear unit on a side thereof facing away from the second gear unit.

20. Rotary drive assembly according to claim 19, further comprising a drive shaft provided on each of the two second drive units, for transmitting torque between the two second drive units and the second gear unit, where each drive shaft runs parallel to the drilling axis, wherein the housing of the first gear unit has two recesses, through which the drive shafts for the second gear unit respectively extend.

* * * * *